US011497666B2

(12) United States Patent
Ermalovich et al.

(10) Patent No.: US 11,497,666 B2
(45) Date of Patent: Nov. 15, 2022

(54) LIGHT WEIGHT SELF-CONTAINED ARTICULATING ASSEMBLY FOR BED FRAME MOUNTING

(71) Applicant: Ergomotion, Inc., Goleta, CA (US)

(72) Inventors: Joseph Ermalovich, Santa Barbara, CA (US); Brett Anthony Towe, Goleta, CA (US); Benjamin D. Harding, Santa Barbara, CA (US)

(73) Assignee: Ergomotion, Inc., Goleta, CA (US)

( * ) Notice: Subject to any disclaimer, the term of this patent is extended or adjusted under 35 U.S.C. 154(b) by 193 days.

(21) Appl. No.: 16/572,561

(22) Filed: Sep. 16, 2019

(65) Prior Publication Data

US 2020/0085656 A1 Mar. 19, 2020

Related U.S. Application Data

(60) Provisional application No. 62/732,502, filed on Sep. 17, 2018.

(51) Int. Cl.
*A61G 7/015* (2006.01)
*A61G 7/018* (2006.01)

(52) U.S. Cl.
CPC ..... *A61G 7/015* (2013.01); *A61G 7/018* (2013.01)

(58) Field of Classification Search
CPC ..... A61G 7/015; A61G 7/018
See application file for complete search history.

(56) References Cited

U.S. PATENT DOCUMENTS 3,583,248 A * 6/1971 Langenberg ..... F16H 25/2454 74/89.39
3,972,081 A * 8/1976 Stern ..... A61G 7/002 5/618
4,545,084 A * 10/1985 Peterson ..... A61G 7/018 5/618
6,739,004 B1 * 5/2004 Abrahamsen ..... A47C 20/041 5/610
RE43,155 E * 2/2012 Allen ..... A61G 7/008 5/618
8,312,579 B2 * 11/2012 Bock ..... A47C 20/08 5/613
10,011,190 B2 * 7/2018 Markel ..... B60N 2/225
2002/0174487 A1 * 11/2002 Kramer ..... A61G 7/015 5/618

(Continued)

*Primary Examiner* — Eric J Kurilla
(74) *Attorney, Agent, or Firm* — Felix L. Fischer

(57) ABSTRACT

An articulating assembly for an adjustable bed has side supports received on side rails of a bed frame. A first axle extends between the side supports and a second axle extending between the side supports defining a fixed center section. An upper body support frame has a first torque tube concentrically received on the first axle. A thigh support frame has a second torque tube concentrically received on the second axle. A first actuator assembly supported in the center section is operably attached to rotate the first torque tube to articulate the upper body support frame over a range of positions from a horizontal unarticulated position to a fully articulated position. A second actuator assembly supported in the center section is operably attached to rotate the second torque tube to articulate the thigh support frame over a range of positions from a horizontal unarticulated position to a fully articulated position.

15 Claims, 14 Drawing Sheets

(56) References Cited

U.S. PATENT DOCUMENTS

| | | | | |
|---|---|---|---|---|
| 2005/0283911 | A1* | 12/2005 | Roussy | A61G 7/012 5/611 |
| 2018/0000670 | A1* | 1/2018 | Bartley | A61G 7/015 |
| 2018/0000672 | A1* | 1/2018 | Heneveld, Jr. | F16D 11/14 |
| 2018/0000674 | A1* | 1/2018 | Bartley | A61G 7/002 |
| 2018/0000675 | A1* | 1/2018 | Heneveld, Jr. | F16H 1/32 |
| 2018/0064589 | A1* | 3/2018 | Sweeney | A61G 7/012 |

* cited by examiner

LIGHT WEIGHT SELF-CONTAINED ARTICULATING ASSEMBLY FOR BED FRAME MOUNTING

REFERENCE TO RELATED APPLICATIONS

This application claims priority of U.S. provisional application Ser. No. 62/732,502 filed on Sep. 17, 2018 entitled LIGHT WEIGHT SELF-CONTAINED ARTICULATING ASSEMBLY FOR BED FRAME MOUNTING having a common assignee with the present application, the disclosure of which is incorporated herein by reference.

BACKGROUND

Field

This invention relates generally to the field of articulating beds and more particularly to a lightweight self-contained articulating base with frame elements supportable in a conventional bed frame.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping. Typical articulating beds provide an upper body positioning element and a thigh and lower leg positioning element either individually active or with combined actuation. Articulating beds are typically specialized with a complete frame, mounting legs and articulating assembly.

Many customers desire bed frame designs which are integrated with an interior design motif and conventional queen, king and super king bed frames are typically provided in these desired design motifs with structural headboards and footboards or cabinet units at the head, foot or both.

It is therefore desirable to provide an articulating assembly which is mountable in a conventional bed frame to provide an articulating bed.

SUMMARY

The embodiments disclosed herein provide an articulating assembly for an adjustable bed having side supports received on side rails of a bed frame. A first axle extends between the side supports and a second axle extending between the side supports defining a fixed center section. An upper body support frame has a first torque tube concentrically received on the first axle. A thigh support frame has a second torque tube concentrically received on the second axle. A first actuator assembly supported in the center section is operably attached to rotate the first torque tube to articulate the upper body support frame over a range of positions from a horizontal unarticulated position to a fully articulated position. A second actuator assembly supported in the center section is operably attached to rotate the second torque tube to articulate the thigh support frame over a range of positions from a horizontal unarticulated position to a fully articulated position.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
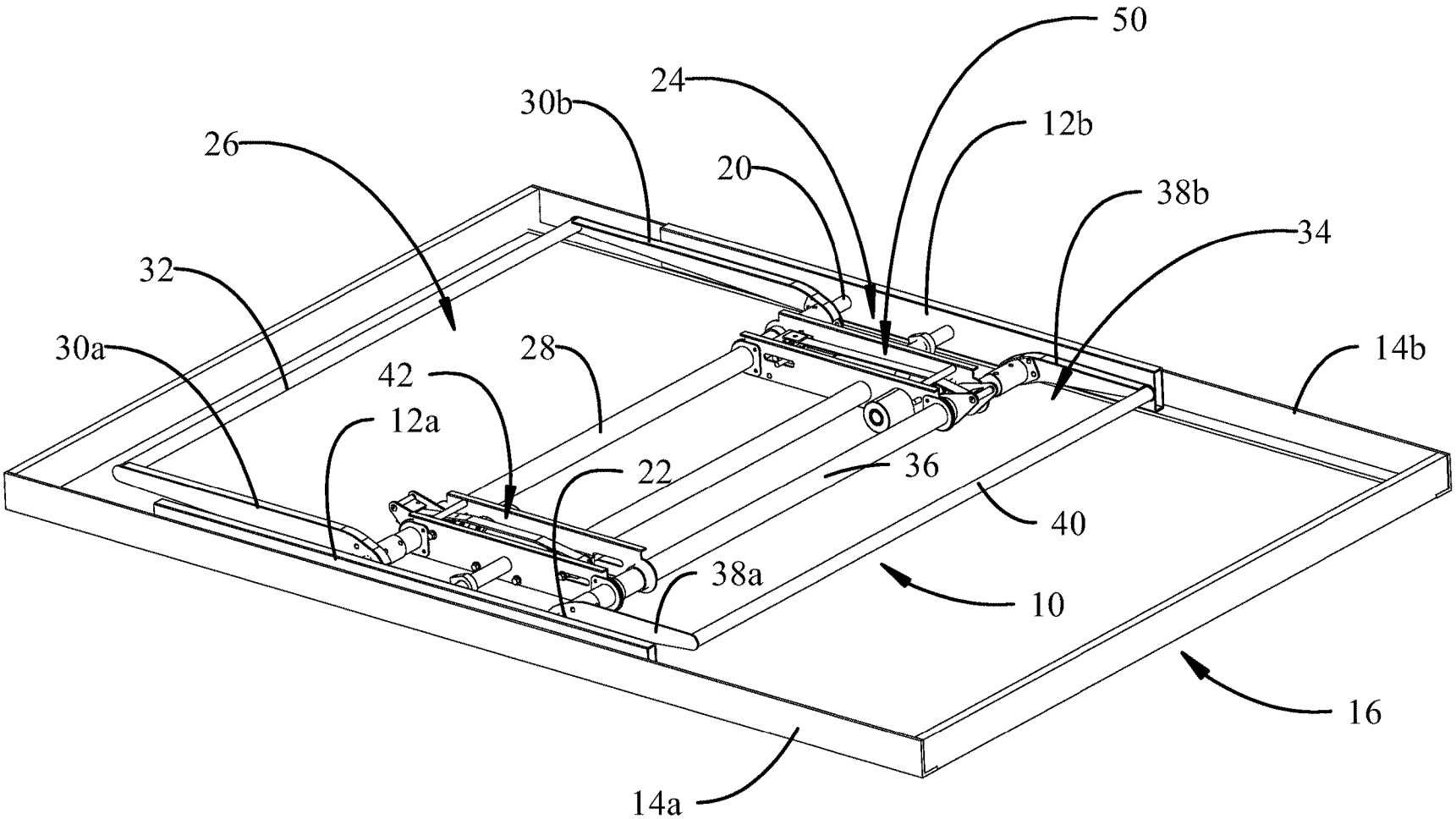
FIG. 1 is a pictorial depiction of an exemplary implementation of the articulating assembly in an unarticulated position.

Implementations shown in the drawings and described herein provide an articulating assembly having an upper body articulation section and a thigh articulation section rotatably attached to a center section that houses actuation systems and is supported by side supports that can be received on a rail frame supported by a head board and foot board.

Referring to the drawings, FIG. 1 shows the articulating assembly 10, in an unarticulated position, having side supports 12*a*, 12*b* which are received on side rails 14*a*, 14*b* of a conventional bed frame 16. The side supports 12*a*, 12*b* may extend the entire length of the side rails 14 or a central portion of the side rails sufficient to position the articulating assembly and react articulation torque. The articulating assembly 10 replaces some or all of the conventional cross slats between the side rails 14*a*, 14*b* which are employed in a conventional bed to support the box spring and/or mattress. A first head end axle 20 and a second foot end axle 22 extend between the side supports 12*a*, 12*b* defining a fixed center section 24 which provides a seat section for a mattress mounted on the articulating assembly. An upper body support frame 26 is rotatably mounted to the center section 22 with a first torque tube 28 concentrically receiving the head end axle 20. Upper side frame elements 30*a* and 30*b* extend from the first torque tube 28 to a head cross element 32. Similarly, a thigh support frame 34 is rotatably mounted to the central section 22 with a second torque tube 36 concentrically receiving the foot end axle 22. Thigh side frame elements 38*a* and 38*b* extend from the second torque tube 36 to a knee cross element 40.

Figure 2:
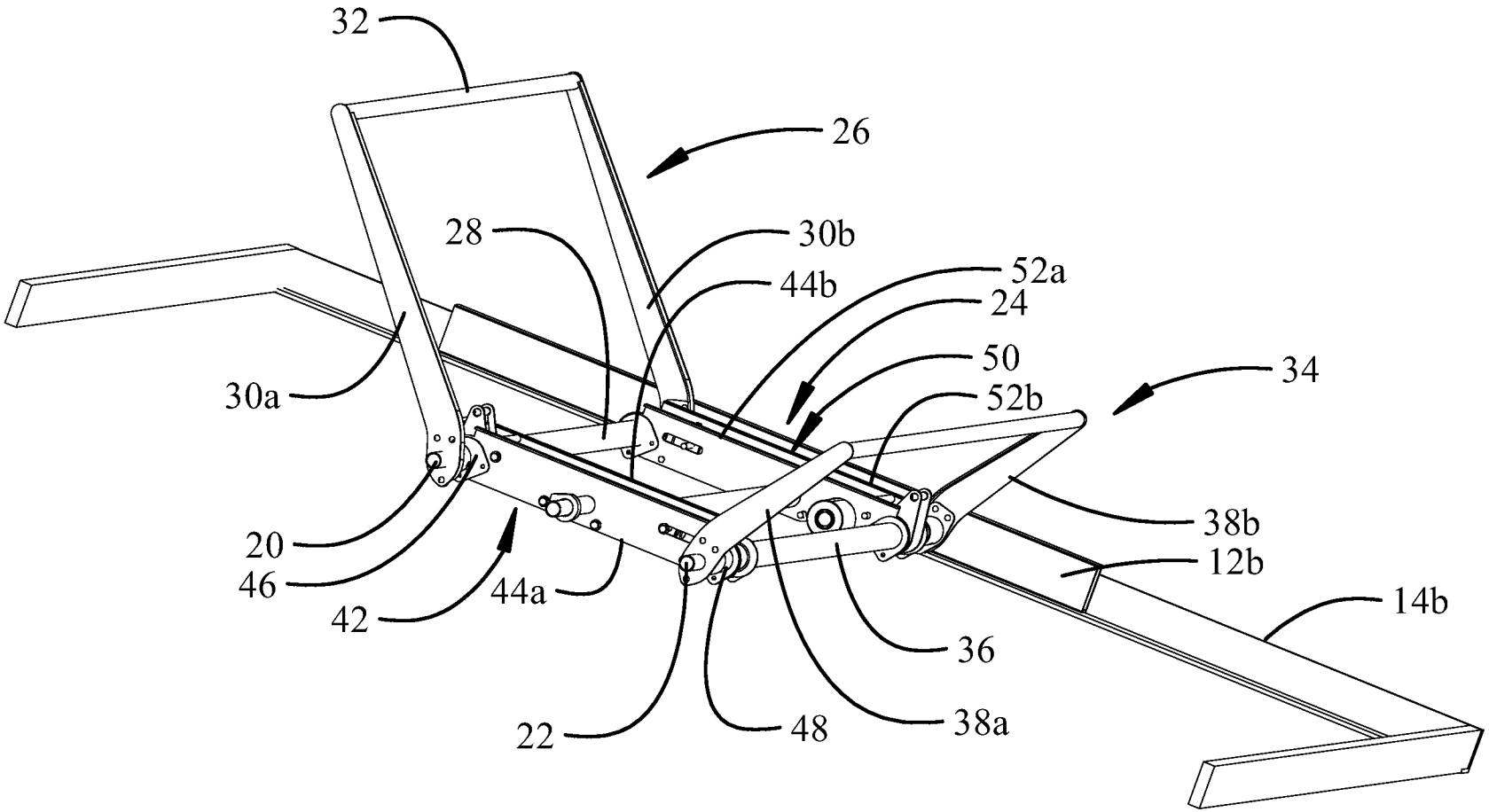
FIG. 2 is a pictorial depiction of the articulating assembly of FIG. 1 in the fully articulated position with the left side support and frame rail removed for clarity.

A first actuator assembly 42 is supported in the center section 24 by first side brackets 44*a* and 44*b*. The first side brackets 44*a*, 44*b* are mounted on head bushings 46 concentrically receiving the first torque tube 28 and foot bushings 48 concentrically receiving the second torque tube 36. The first actuator assembly 42 is supported by the first and second torque tubes 28, 36 and the head and foot end axles 20, 22 while allowing the first and second torque tubes 28, 36 to rotate in the head bushings 46 and foot bushings 48. The first actuator assembly 42 is operably attached, as will be described in greater detail subsequently, to rotate the first torque tube 28 to articulate the upper body support frame 26 over a range of positions from a horizontal unarticulated position (seen in FIG. 1) to a fully articulated position as seen in FIG. 2.

A second actuator assembly 50 is supported in the center section 24 by second side brackets 52*a* and 52*b*. Similar to the first actuator assembly, the second side brackets 52*a*, 52*b* are mounted on head bushings 54 concentrically receiving the first torque tube 28 and foot bushings 56 concentrically receiving the second torque tube 36. The second actuator assembly 50 is supported by the first and second torque tubes 28, 36 and the head and foot end axles 20, 22 while allowing the first and second torque tubes 28, 36 to rotate in the head bushings 54 and foot bushings 56. The second actuator assembly 50 is operably attached, as will be described in greater detail subsequently, to rotate the second torque tube 36 to articulate the thigh support frame 34 over a range of positions from a horizontal unarticulated position (seen in FIG. 1) to a fully articulated position as seen in FIG. 2.

The first and second actuator assemblies 42, 50 are restrained from lateral motion on the torque tubes by lateral supports 58*a* and 58*b* connected between the first side bracket 44*a* and side support 12*a* and the second side bracket 52*b* and side support 12*b*, respectively. A central lateral spacer 60 is employed in the exemplary implementation for maintaining relative position of the first and second actuator assemblies by interconnecting first side bracket 44*b* and second side bracket 52*a*.

Figure 3:
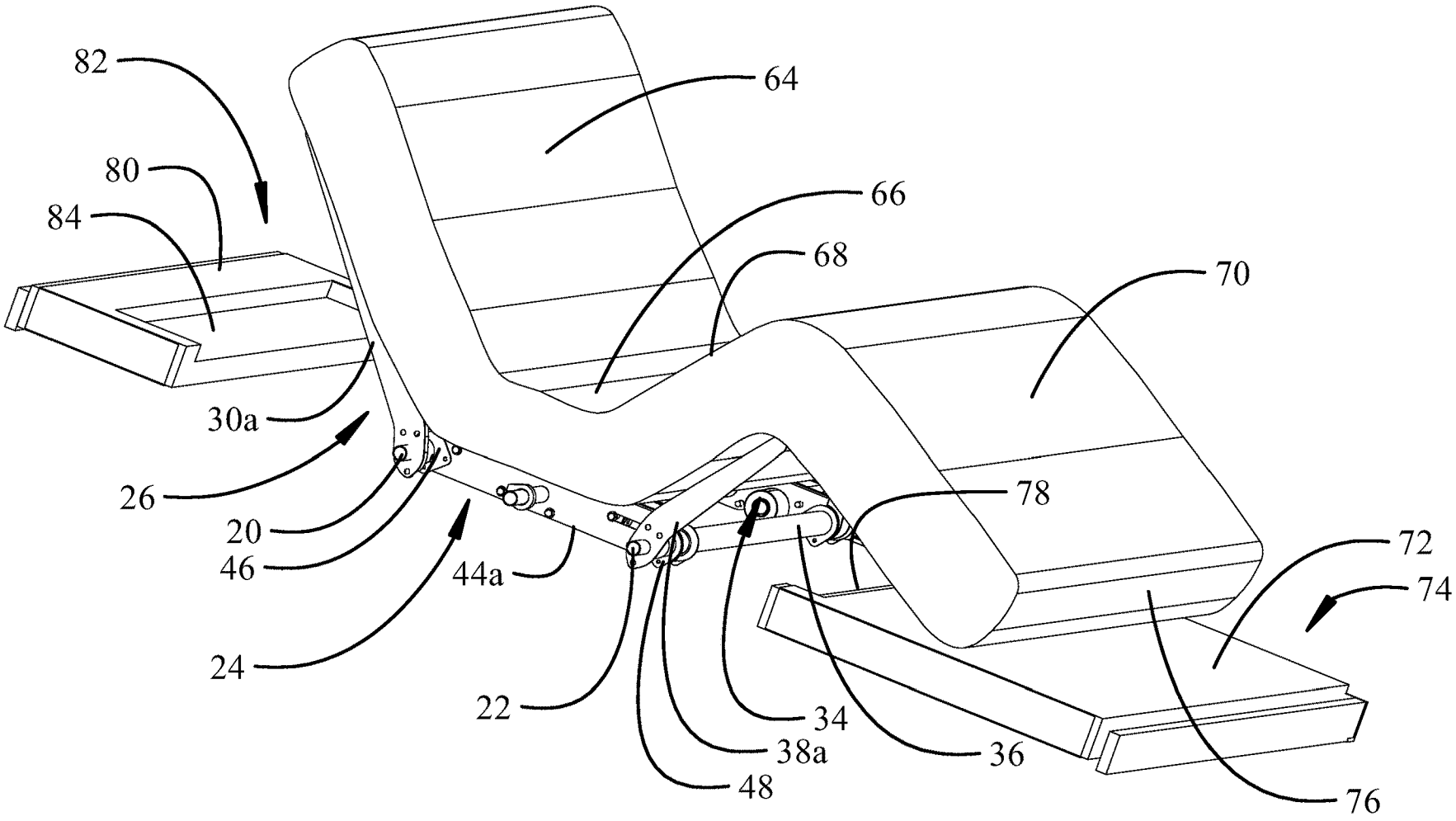
FIG. 3 is a pictorial depiction of the articulating assembly supporting a mattress with additional features.

As seen in FIG. 3 with a mattress 62 supported on the articulating assembly, articulation of the upper body support frame 26 angularly elevates an upper section 64 of the mattress from a seat section 66 which remains supported on the fixed center section 24. Articulation of the thigh support frame 34 angularly elevates a thigh section 68 of the mattress from the seat section 66 with a lower leg section 70 draping from the knee cross element 40 to provide comfortable elevation of the legs.

For the implementation as shown in FIG. 3, a foot support box 72 may be employed to extend between the side rails 14 over a foot portion 74 of the bed. The foot support box allows sliding support of a foot end 76 of the mattress 62 to prevent overbending or binding of the mattress foot end during articulation of the thigh support frame 34 up or down. A relief 78 in the foot support box 72 may be employed to receive the knee cross element 40 and a foot portion of the thigh side frame elements 38*a*, 38*b* for flush support of the mattress in the unarticulated position.

Similarly, a head support box 80 may be employed to extend between the side rails 14 over a head portion 82 of the bed. A relief 84 in the head support box 80 may be employed to receive the head cross element 32 and a head portion of the upper body side frame elements 30*a*, 30*b* for flush support of the mattress in the unarticulated position.

Figure 4:
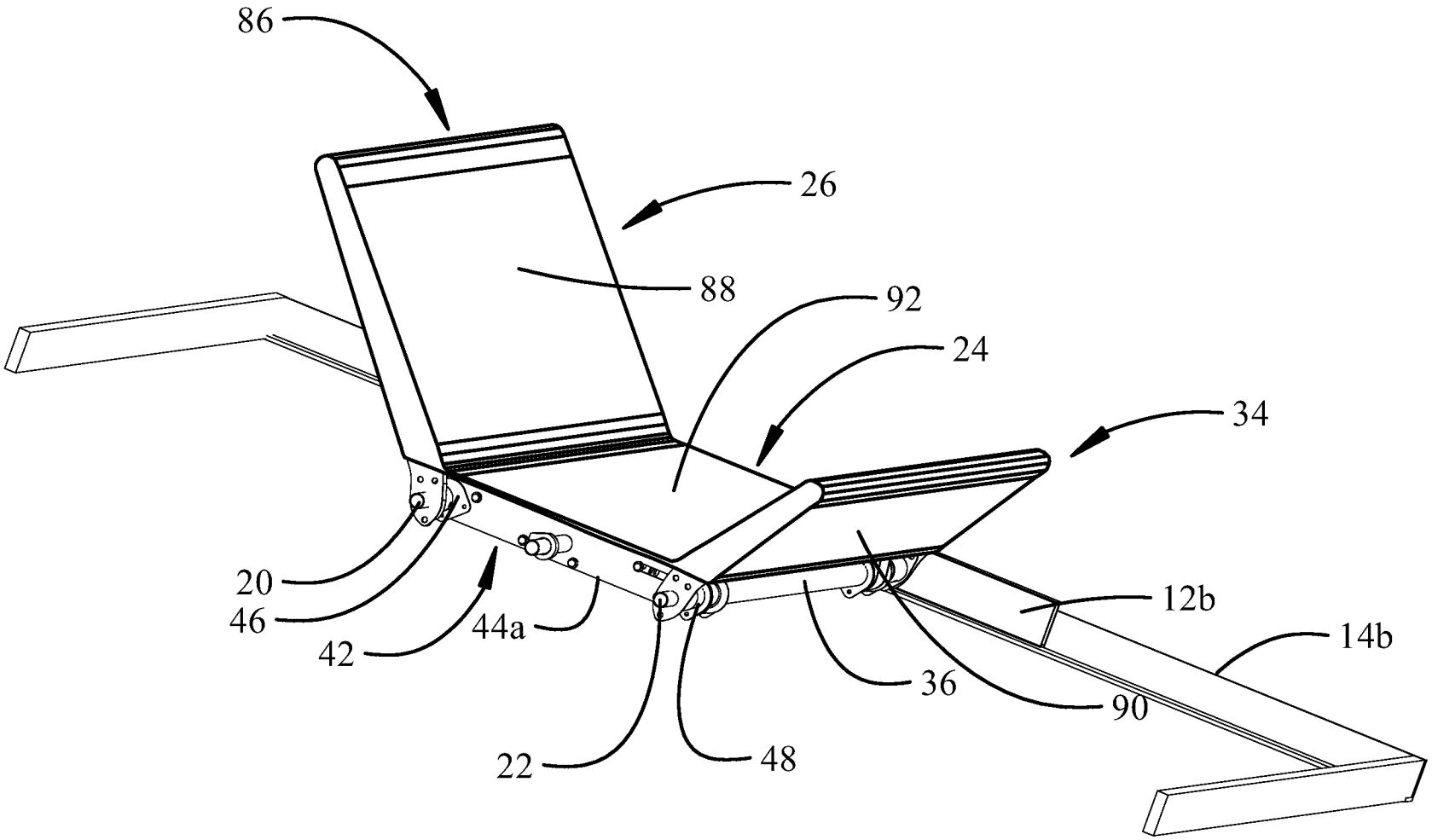
FIG. 4 is a pictorial depiction of the articulating assembly with the flexible sleeve extending over the upper body support frame and thigh support frame with the intermediate web covering the fixed center section.

To provide additional support of the mattress 62 on the upper body support frame 26 and thigh support frame 34, lateral web elements 84 may extend between the upper side frame elements 30*a*, 30*b* and thigh side frame elements 38*a*, 38*b* at spaced intervals. Alternatively, or in addition to the lateral web elements, as shown in FIG. 4, a sleeve 86 having an upper pocket 88 receiving the upper body support frame 26 and a foot pocket 90 receiving the thigh support frame 34 with an interconnecting web 92 between the upper pocket 88 and foot pocket 90 covering the center section 24 may be employed. As an additional alternative, a flexible mattress support as disclosed in U.S. Pat. No. 8,910,328 secured to the upper body support frame 26 and center section 22 may also be employed.

Figure 5A:
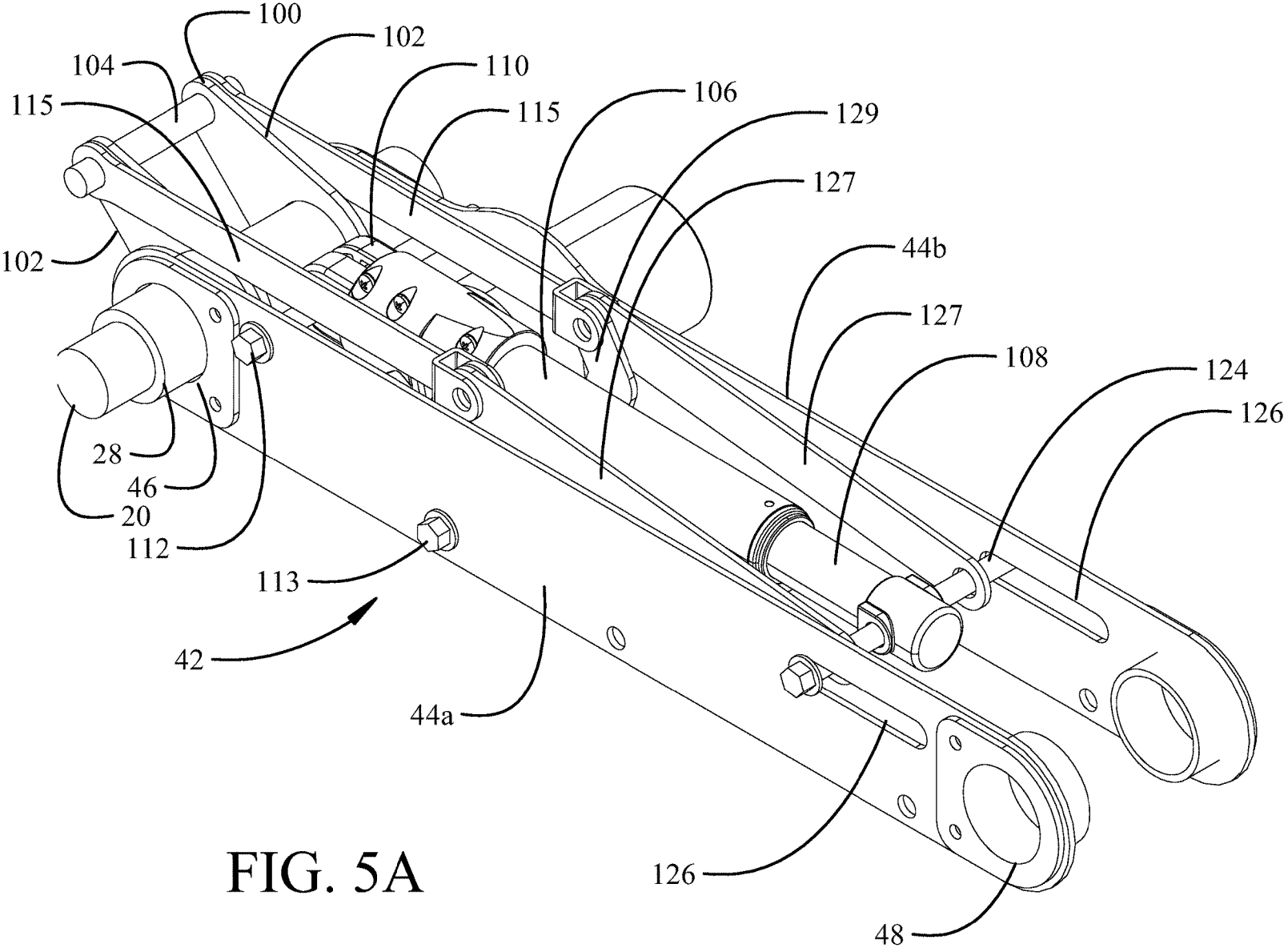
FIGS. 5A-5D are detailed views of a first exemplary implementation of the actuator assemblies for articulation of upper body support frame and thigh support frame.
Figure 5B:
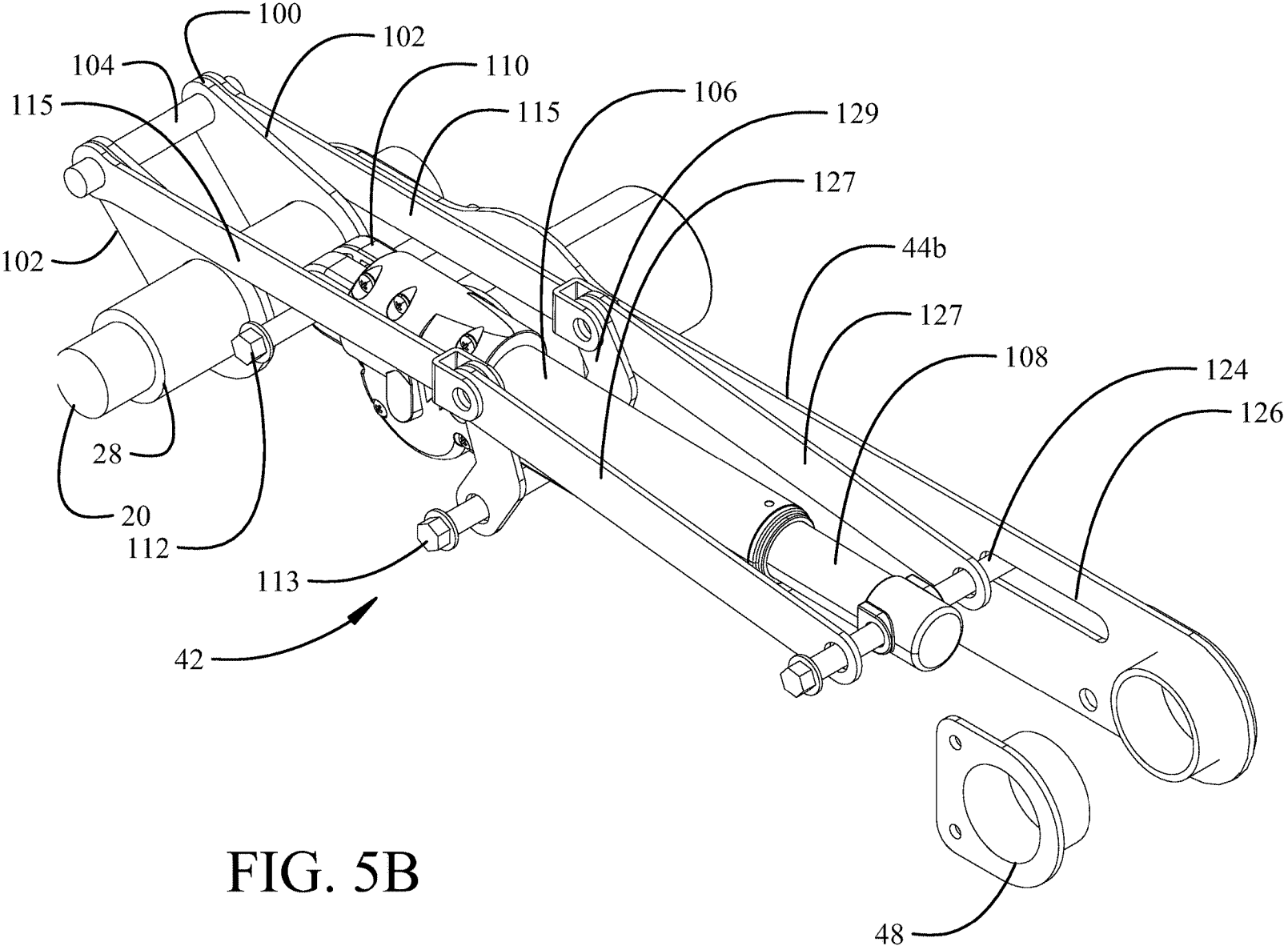
Figure 5C:
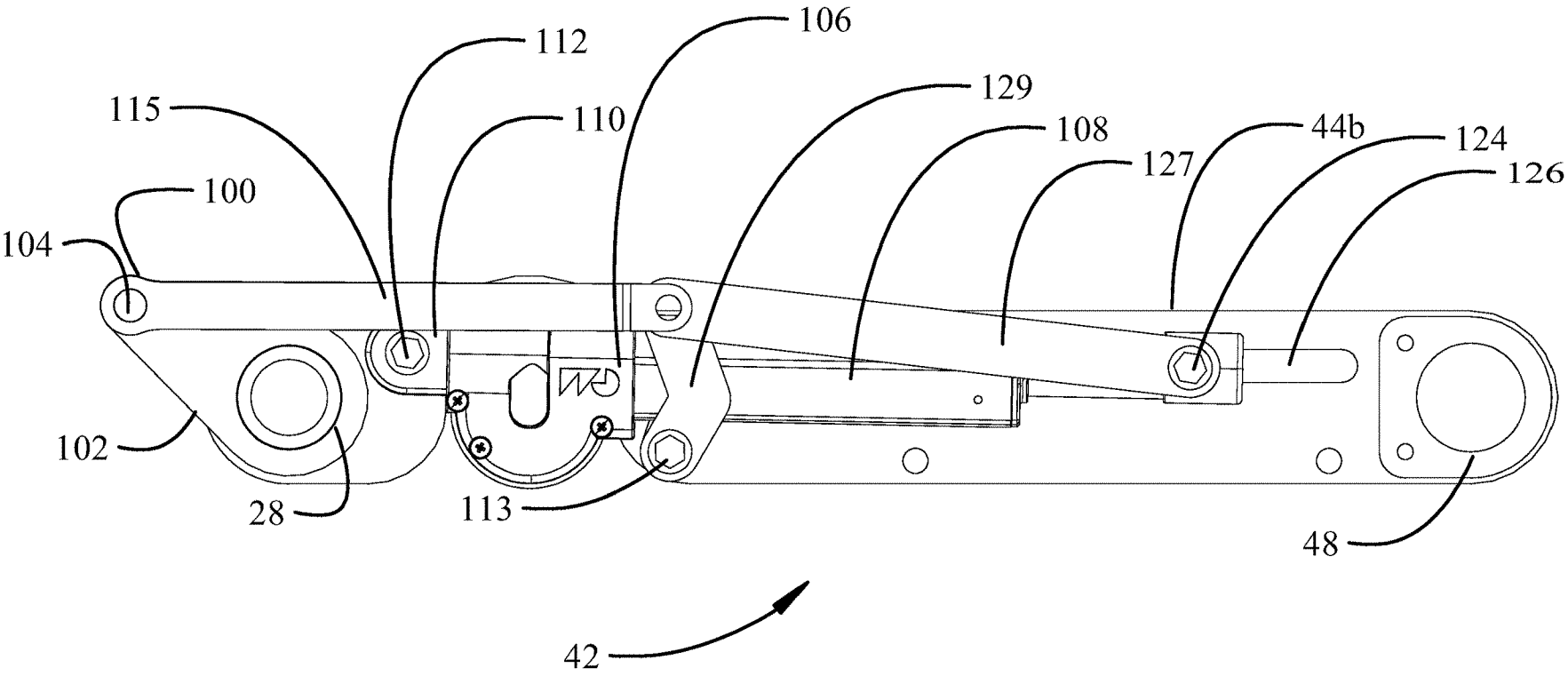
Figure 5D:
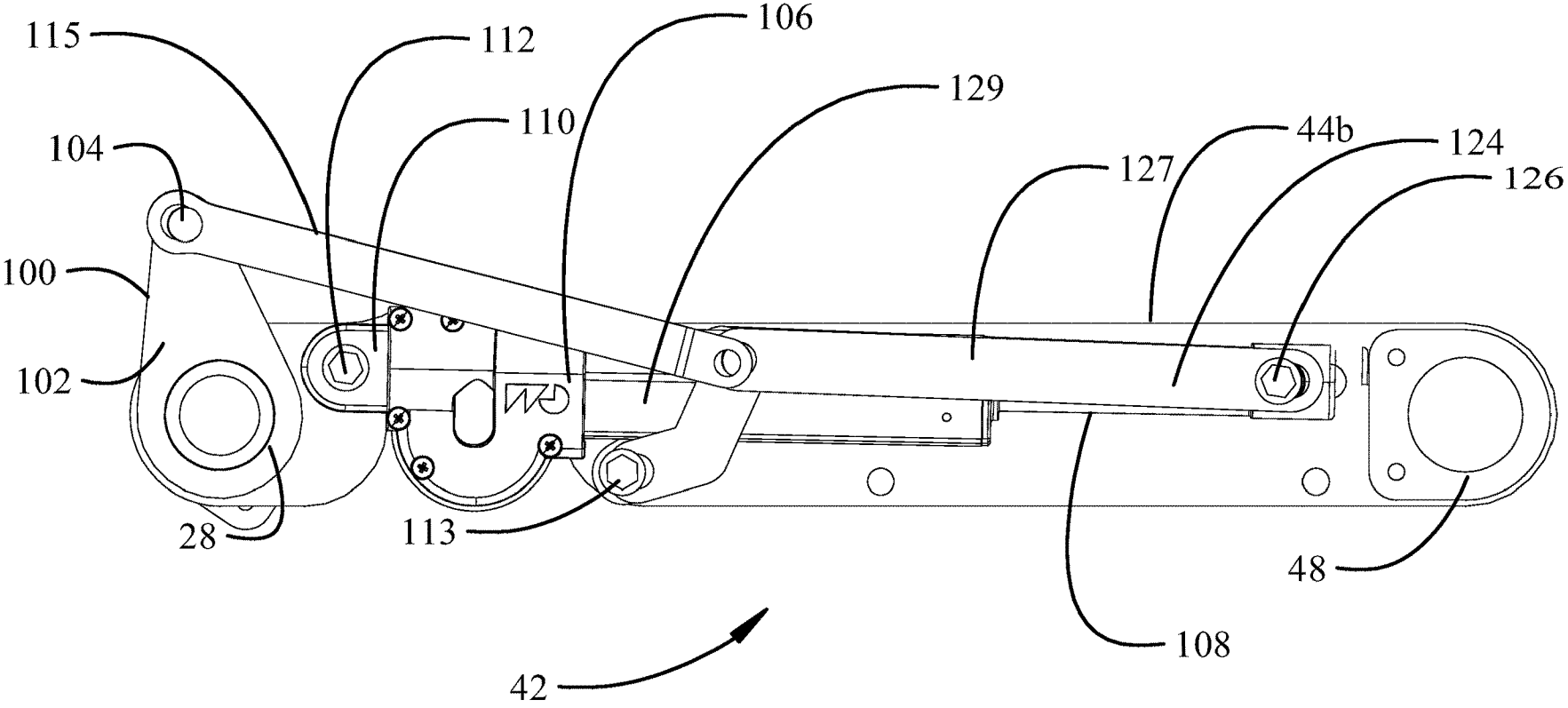

Details of a first exemplary implementation of the first and second actuator assemblies are shown in FIGS. 5A-5D. Described with respect to first actuator assembly 42 for articulation of upper body support frame 26 but identically implementable in second actuator 50 for articulation of thigh support frame 34, a torque lever 100 is attached to the first torque tube 28 with side tangs 102 connected by a top rod 104. An actuator 106 has an actuating rod 108 operably attached to the top rod 104 (as best seen in FIG. 5B). The actuator 106 is attached at a tail pivot 110 to a cross bar 112 extending between the first side brackets 44*a*, 44*b* proximate the first torque tube 28. Extension of the actuating rod 108 drives an axle 124 in slots 126 urging lever arms 127 to rotate angle arms 129 about a second cross bar 113. Tension arms 115 extending from the angle arms 129 and attached to the top rod 104 rotate the torque lever 100 and torque tube 28 from an unarticulated position (as best seen in FIG. 5C), to articulate the upper body support frame 26 to a fully articulated position as seen in FIG. 5D.

Figure 6A:
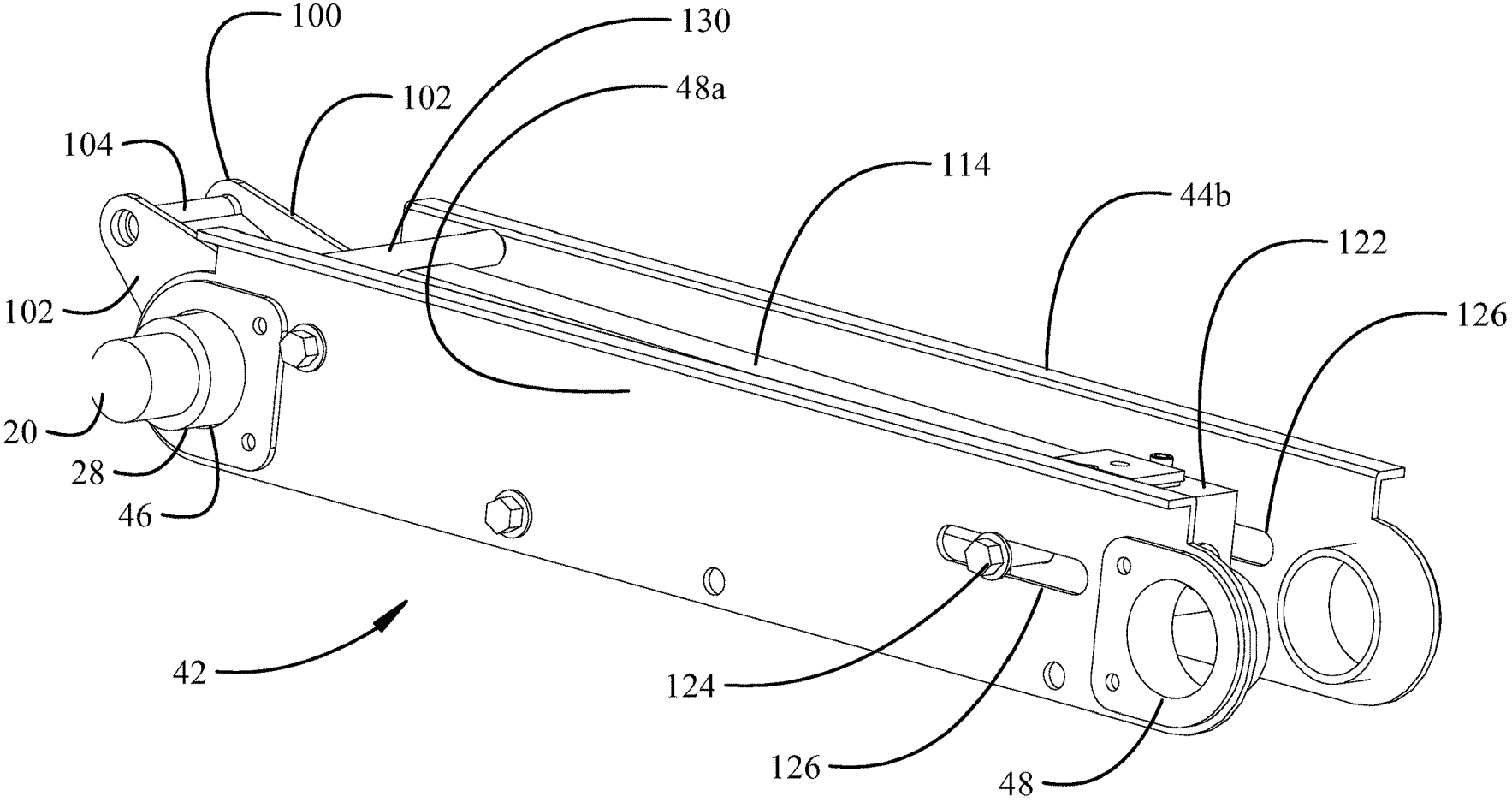
FIGS. 6A-6C are detailed views of a second exemplary implementation of the actuator assemblies for articulation of upper body support frame and thigh support frame employing a flexible strap for actuator engagement; and, FIGS. 7A-7C are detailed views of a third exemplary implementation of the actuator assemblies for articulation of upper body support frame and thigh support frame employing a flexible strap for actuator engagement with an intervening pulley.
Figure 6B:
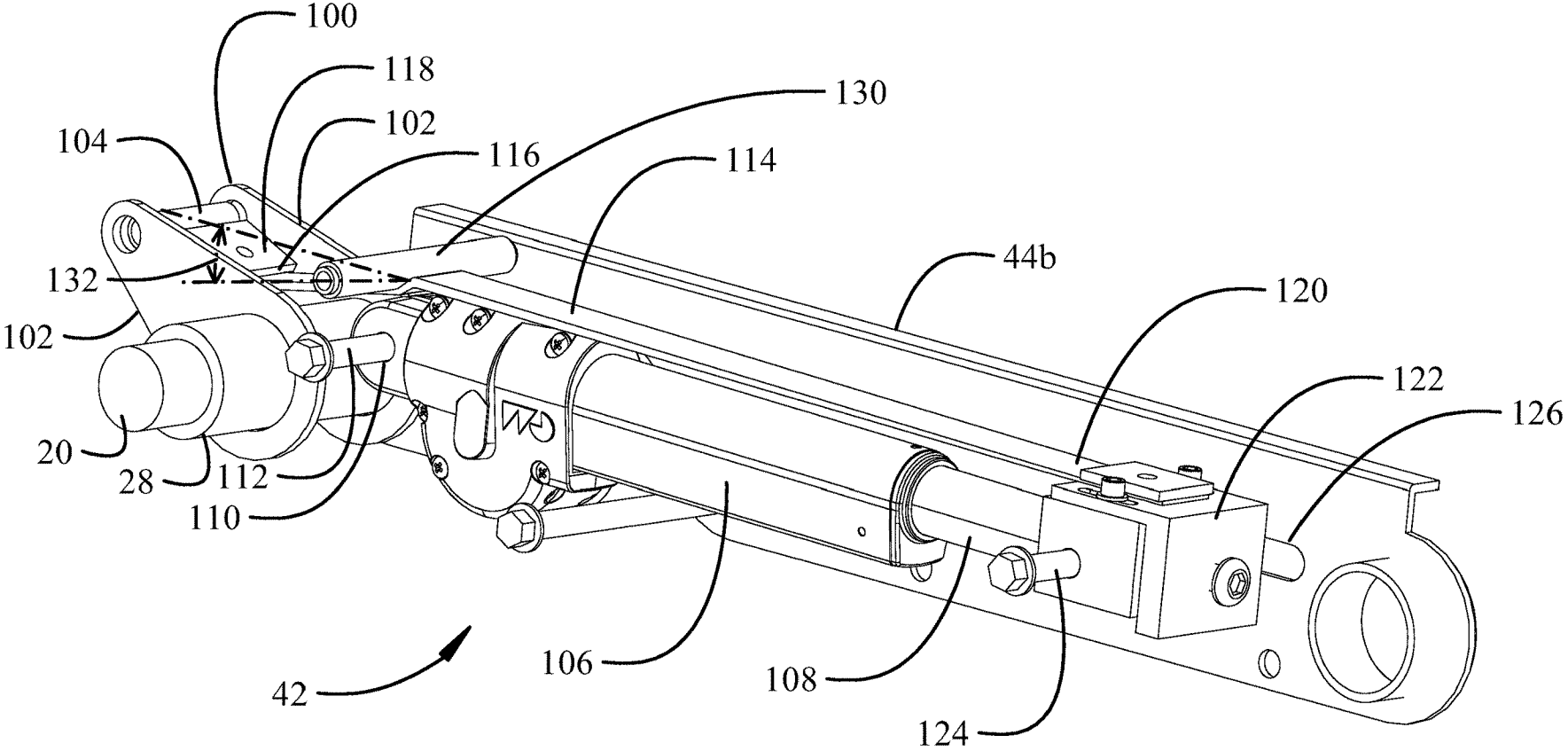
Figure 6C:
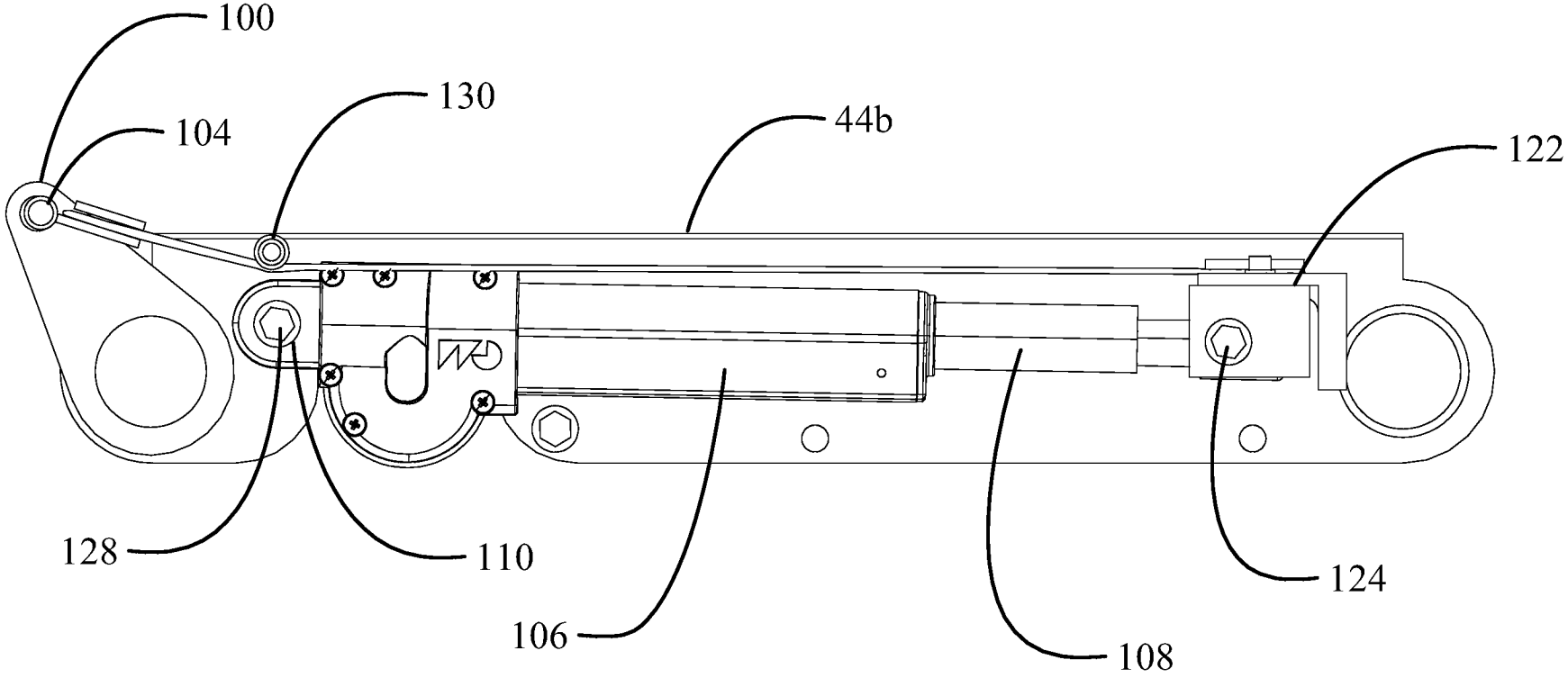

Details of a second exemplary implementation of the first and second actuator assemblies are shown in FIGS. 6A-6C. Described again with respect to first actuator assembly 42 for articulation of upper body support frame 26 but identically implementable in second actuator 50 for articulation of thigh support frame 34, a torque lever 100 is attached to the first torque tube 28 with side tangs 102 connected by a top rod 104. A flexible strap 114 (best seen in FIG. 6B with side bracket 44*a* removed for clarity) is attached at first end 116 to the top rod 104 of the torque lever 100, using clamping plates 118 for the embodiment shown. The flexible strap 114 extends to a second end 120 attached to a trolley 122 mounted between the side brackets 44*a*, 44*b* distal from the torque tube 28 for reciprocal motion on axle 124 received in slots 126 in the side brackets. Attachment to the trolley is accomplished with a mounting plate 127 for the implementation shown. Actuator 106 is mounted at the tail pivot 110 to a second cross bar 128 proximate the torque tube 28 with actuating rod 108 attached to the trolley 122. Extension of the actuating rod 108 reciprocates the trolley 122 tensioning the flexible strap 114 to rotate the torque lever 100 (as best seen in FIG. 6C) articulating the upper body support frame 26. An angle roller 130 extends between the side brackets 44*a*, 44*b* proximate the torque tube 28 to contact the flexible strap 114 creating an offset angle 132 in the flexible strap which eliminates any over-center condition of the torque lever and maintains positioning of the strap between the side brackets during articulation thereby allowing a minimum thickness of the actuator assembly.

Figure 7A:
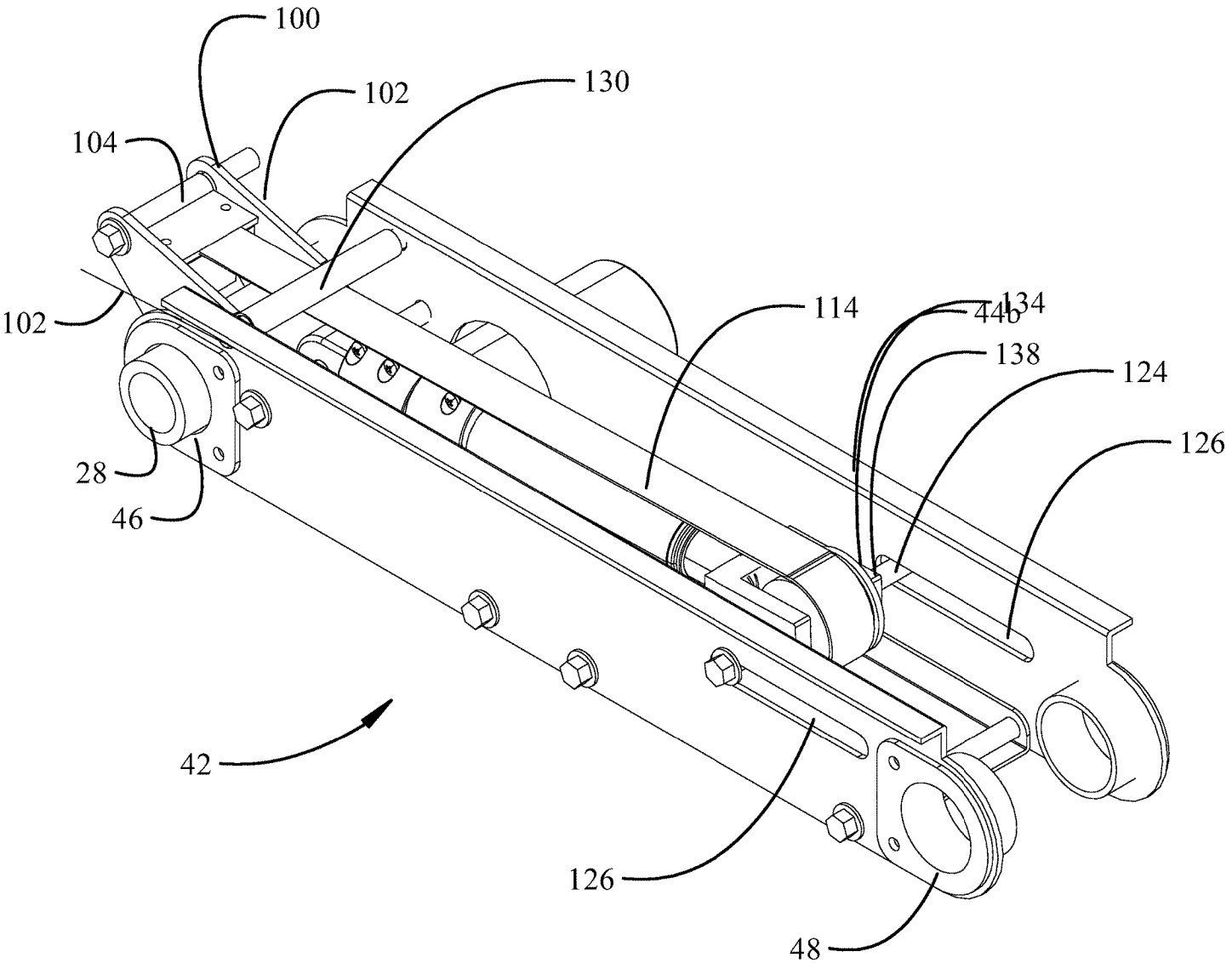
Figure 7B:
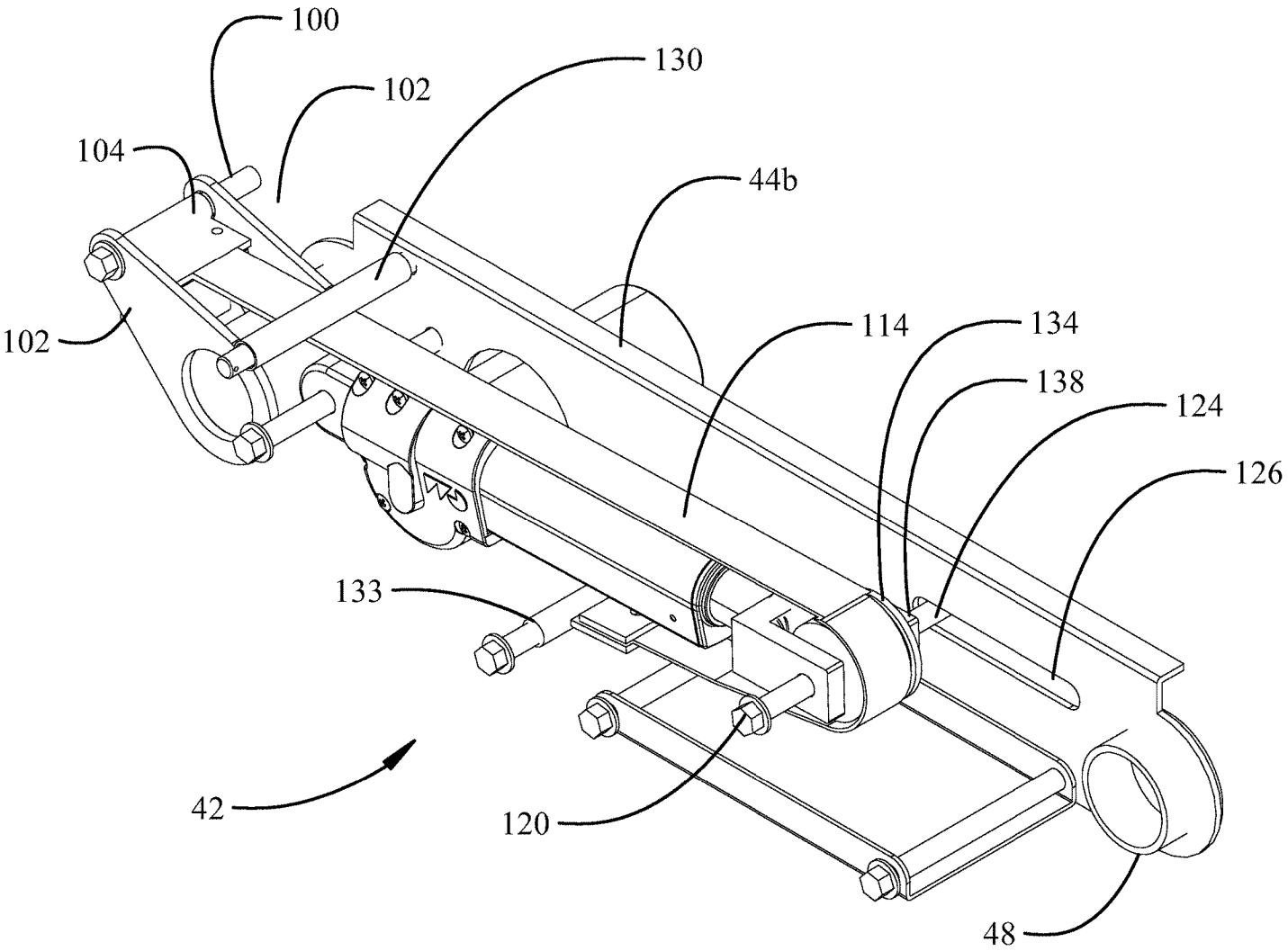
Figure 7C:
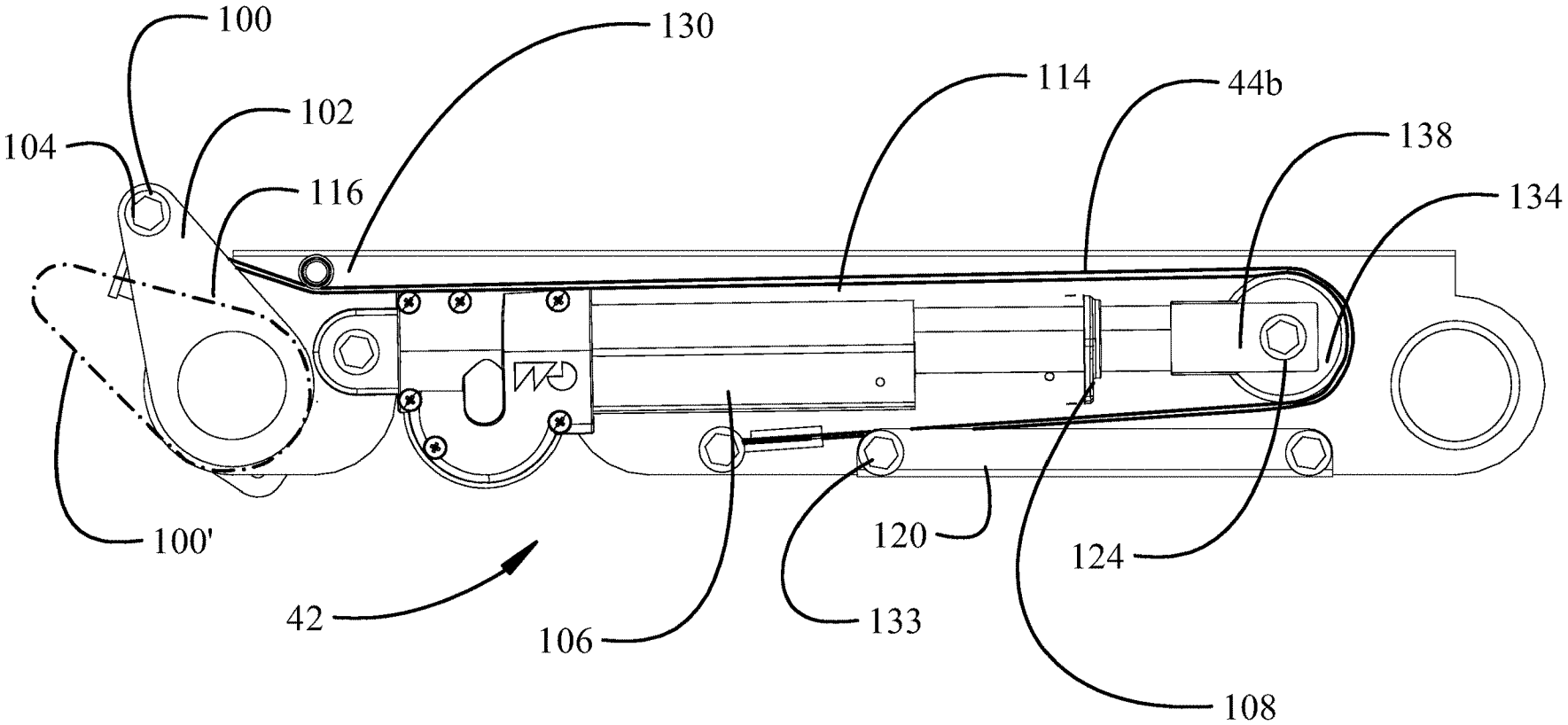

Details of the third exemplary implementation of the first and second actuator assemblies are shown in FIGS. 7A-7C. Described again with respect to first actuator assembly 42 for articulation of upper body support frame 26 but identically implementable in second actuator 50 for articulation of thigh support frame 34, a torque lever 100 is attached to the first torque tube 28 with side tangs 102 connected by a top rod 104. A flexible strap 114 is attached at first end 116 to the top rod 104 of the torque lever 100, using clamping plates 118 for the embodiment shown. The flexible strap 114 extends over a pulley 134 mounted between the side brackets 44*a*, 44*b* distal from the torque tube 28 for reciprocal motion on an axle 124 received in slots 126 in the side brackets. The flexible strap 114 is fixed at the second end 120 to a third cross bar 133 to react the tension in the strap.

Actuator 106 is mounted at the tail pivot 110 to second cross bar 128 proximate the torque tube 28 with actuating rod 108 attached to a clevis 138 attached to the axle 136. Extension of the actuating rod 108 reciprocates the clevis 138, axle 136 and pully 134 tensioning the flexible strap 114 to rotate the torque lever 100 (from the unarticulated position represented by 100') articulating the upper body support frame 26. As in the second exemplary implementation, an angle roller 130 extends between the side brackets 44*a*, 44*b* proximate the torque tube 28 to contact the flexible strap 114 creating an offset angle 132 in the flexible strap which eliminates any over-center condition of the torque lever and maintains positioning of the strap between the side brackets during articulation thereby allowing a minimum thickness of the actuator assembly.

The first and second actuator assemblies may employ a common arrangement of any of the three exemplary implementations or may employ different arrangements of any of the three exemplary implementations or variations thereof.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. An articulating assembly for an adjustable bed comprising:

side supports received on side rails of a bed frame;

a first axle extending between the side supports and a second axle extending between the side supports, said first axle and said second axle defining a fixed center section;

an upper body support frame having a first torque tube concentrically received on the first axle, said first torque tube rotatable by a first torque lever;

a thigh support frame having a second torque tube concentrically received on the second axle, said second torque tube rotatable by a second torque lever;

a first actuator assembly supported in the center section, said first actuator assembly operably attached to the first torque lever to rotate the first torque tube to articulate the upper body support frame over a range of positions from a horizontal unarticulated position to a fully articulated position; and a second actuator assembly supported in the center section, said second actuator assembly operably attached to the second torque lever to rotate the second torque tube to articulate the thigh support frame over a range of positions from a horizontal unarticulated position to a fully articulated position.

2. The articulating assembly as defined in claim 1 wherein the upper body support section comprises upper side frame elements extending from the first torque tube to a head cross element.

3. The articulating assembly as defined in claim 2 further comprising a head support box extending between the side rails over a head portion of the bed frame, said head support box having a relief to receive the head cross element and a head portion of the upper body side frame elements for flush support of a mattress in the unarticulated position.

4. The articulating assembly as defined in claim 2 wherein the thigh support section comprises thigh side frame elements extending from the second torque tube to a knee cross element.

5. The articulating assembly as defined in claim 4 further comprising a foot support box extending between the side rails over a foot portion of the bed frame, said foot support box providing sliding support of a foot end of a mattress mounted on the articulating assembly to prevent overbending or binding of the mattress foot end during articulation of the thigh support frame up or down, said foot support box having a relief to receive the knee cross element and a foot portion of the thigh side frame elements for flush support of the mattress in the unarticulated position.

6. The articulating assembly as defined in claim 4 further comprising a sleeve having an upper pocket receiving the upper body support frame and a foot pocket receiving the thigh support frame with an interconnecting web between the upper pocket and foot pocket covering the center section.

7. An articulating assembly bed comprising:

side supports received on side rails of a bed frame;

a first axle extending between the side supports and a second axle extending between the side supports, said first axle and said second axle defining a fixed center section;

an upper body support frame having a first torque tube concentrically received on the first axle and upper side frame elements extending from the first torque tube to a head cross element;

a thigh support frame having a second torque concentrically received on the second axle and thigh side frame elements extending from the second torque tube to a knee cross element;

a first actuator assembly supported in the center section, said first actuator assembly operably attached to rotate the first torque tube to articulate the upper body support frame over a range of positions from a horizontal unarticulated position to a fully articulated position; and a second actuator assembly a supported in the center section, said second actuator assembly operably attached to rotate the second torque tube to articulate the thigh support frame over a range of positions from a horizontal unarticulated position to a fully articulated position;

wherein the first actuator assembly comprises:

first side brackets having head bushings concentrically receiving the first torque tube and foot bushings concentrically receiving the second torque tube, the first actuator assembly supported by the first and second torque tubes, said first and second torque tubes rotatable in the head bushings and foot bushings respectively.

8. The articulating assembly as defined in claim 7 further comprising a first lateral support connected between a first one of said first side brackets and a first one of said side supports and a second lateral support connected between a first one of said second side brackets and a second one of said side supports.

9. The articulating assembly as defined in claim 8 further comprising a central lateral spacer connected between a second one of said first side brackets and a second one of said second side brackets.

10. The articulating assembly as defined in claim 7 further comprising:

a torque lever attached to the first torque tube with side tangs connected by a top rod;

an actuator having an actuating rod operably attached to the top rod, the actuator attached at a tail pivot to a cross bar extending between the first side brackets proximate the first torque tube, wherein extension of the actuating rod induces rotation of the torque lever and first torque tube.

11. The articulating assembly as defined in claim 10 further comprising:

an axle receive in slots in said first side brackets and attached to said actuating rod;

lever arms extending from the axle and pivotally engaged to angle arms rotatably mounted to a second cross bar;

tension arms extending from the angle arms and attached to the top rod whereby extension of the actuating rod rotates the torque lever.

12. The articulating assembly as defined in claim 10 further comprising:

a trolley attached to the actuating rod and mounted between the first side brackets distal from the torque tube for reciprocal motion on an axle received in slots in the side brackets; and, a flexible strap attached at first end to the top rod, said flexible strap extending to a second end attached to the trolley whereby extension of the actuating rod rotates the torque lever.

13. The articulating assembly as defined in claim 12 further comprising an angle roller extending between the first side brackets proximate the torque tube and contacting the flexible strap creating an offset angle in the flexible strap.

14. The articulating assembly as defined in claim 10 further comprising:

a pulley mounted between the first side brackets distal from the torque tube for reciprocal motion on an axle received in slots in the side brackets;

a flexible strap attached at first end to the top rod, the flexible strap extending over the pulley and at a second end to a third cross bar to react the tension in the strap; and, a clevis rotatably supporting the pulley and attached to the axle and actuating rod, whereby extension of the actuating rod reciprocates the clevis, axle and pulley thereby tensioning the flexible strap to rotate the torque lever.

15. The articulating assembly as defined in claim 14 further comprising an angle roller extending between the first side brackets proximate the torque tube and contacting the flexible strap creating an offset angle in the flexible strap.

* * * * *